United States Patent [19]

Bock

[11] Patent Number: 4,508,010

[45] Date of Patent: Apr. 2, 1985

[54] HYDRAULIC MOTOR

[76] Inventor: Rudolf Bock, Palmerstrasse 9, 7031 Holzgerlingen, Fed. Rep. of Germany

[21] Appl. No.: 499,235

[22] Filed: May 31, 1983

[30] Foreign Application Priority Data

May 29, 1982 [DE] Fed. Rep. of Germany ..... 3220492

[51] Int. Cl.[3] ..... F01B 1/06; F01B 13/06; F04B 1/10

[52] U.S. Cl. ..... 91/474; 91/490; 91/498

[58] Field of Search ..... 91/474, 490, 491, 492, 91/493, 494, 495, 496, 497, 498; 417/273; 308/196, 202

[56] References Cited

U.S. PATENT DOCUMENTS

| | | | |
|---|---|---|---|
| 932,033 | 8/1909 | Krone | 91/497 X |
| 2,111,657 | 3/1938 | Benedek | 91/496 |
| 2,938,504 | 5/1960 | Wadefelt | 91/498 |
| 4,318,336 | 3/1982 | Bock | 91/474 |

FOREIGN PATENT DOCUMENTS

| | | | |
|---|---|---|---|
| 2853552 | 6/1980 | Fed. Rep. of Germany | 91/490 |
| 47101 | 10/1936 | France | 91/498 |
| 1348882 | 12/1963 | France | 91/498 |
| 124069 | 3/1919 | United Kingdom | 91/491 |
| 822382 | 10/1959 | United Kingdom | 91/490 |

*Primary Examiner*—William L. Freeh
*Assistant Examiner*—Paul F. Neils
*Attorney, Agent, or Firm*—Michael J. Striker

[57] ABSTRACT

A hydraulic motor is comprised of a rotatable rotor positioned in a stationary housing and provided with a number of radial hollow pistons with cup-shaped cylinders displaceable thereon. The rotor is arranged within the housing by means of a single roller bearing on the driven-side of the rotor; the bearing which is offset radially outwardly from the central axis of the motor absorbs radial and axial forces exerted on the rotor.

6 Claims, 3 Drawing Figures

FIG. 2
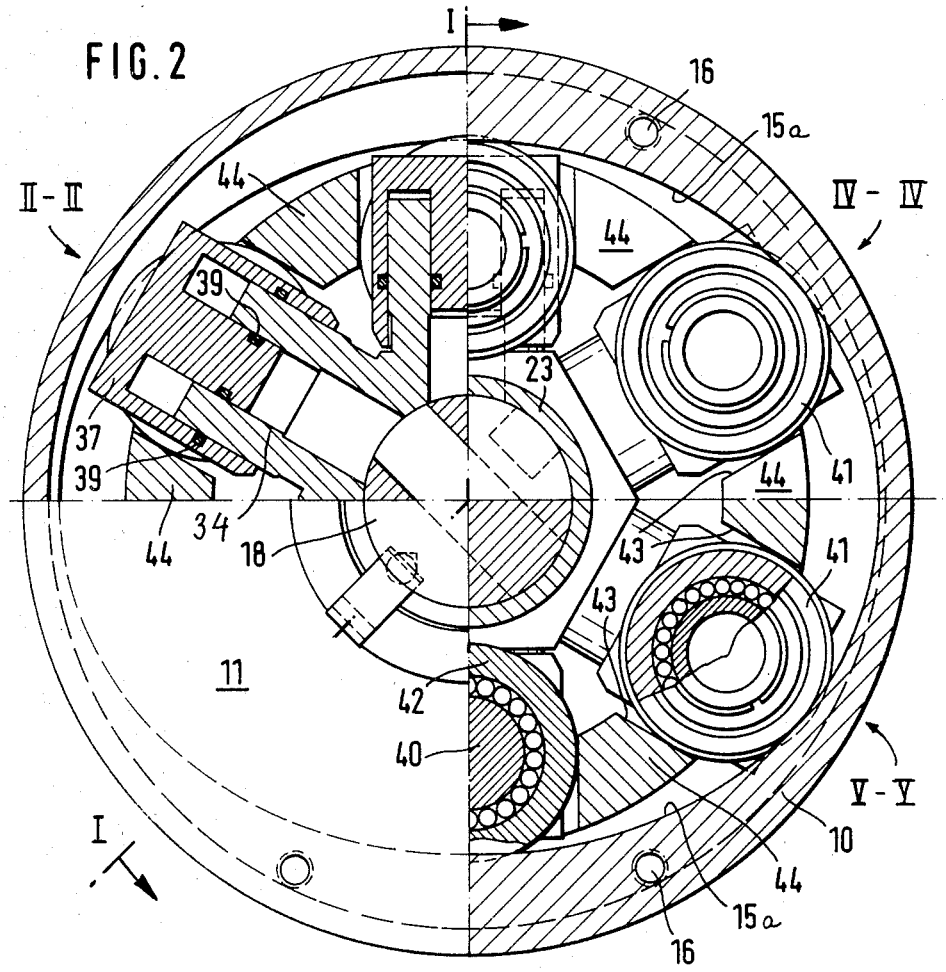
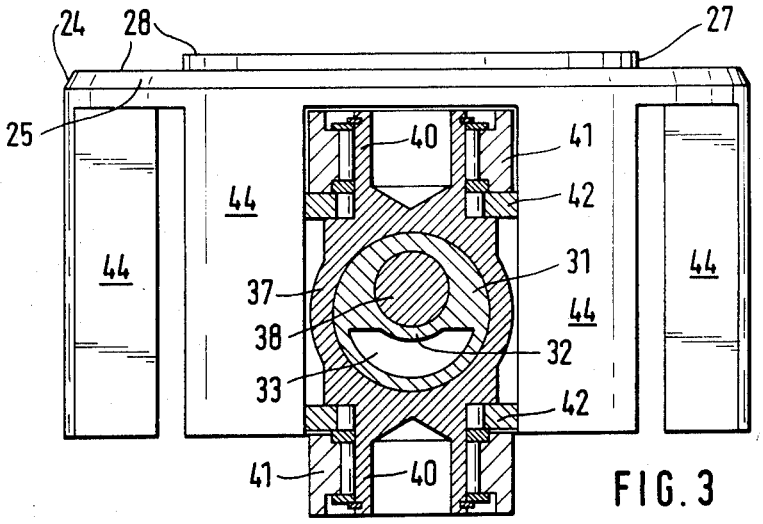
FIG. 3

HYDRAULIC MOTOR

BACKGROUND OF THE INVENTION

The present invention relates to a hydraulic motor. More particularly, the invention relates to a hydraulic motor which includes a stationary housing, a rotor disposed in the housing and provided with a plurality of axially extending and outwardly open hollow pistons and a plurality of cylinders, each cylinder being movable over the respective piston and having a couple of axially disposed journals cooperating with cam tracks formed on the inner wall of the stationary housing. The hydraulic motor of the foregoing type further includes a control shaft mounted within the rotor and adapted to transmit pressure fluid from the pressure fluid lines to the hollow radial pistons.

Hydraulic motors of the type under discussion are known in the art. One of such motors is disclosed, for example in British Pat. No. 12 42381. These hydraulic motors have the advantage, that due to the above described design with radial pistons, they can be designed to be compact in the radial direction, in other words with a relatively small outer diameter of the housing. The utilization of such hydraulic motors, does not depend solely on the outer diameters of the motors. If a hub wheel hydraulic motor is used as an individual drive of the vehicle wheel, efforts should be made to obtain the shortest possible overall length of such a motor.

SUMMARY OF THE INVENTION

It is an object of the present invention to provide an improved hydraulic motor.

It is another object of the invention to provide a hydraulic motor which is compact in the radial direction and in the axial direction as well, which hydraulic motor would have a shorter overall length as compared to conventional hydraulic motors of the foregoing type without, however, forfeiting stability and duration of the motor.

These and other objects of the invention are attained by a multi-piston hydraulic motor, comprising a stationary housing, a rotor having a central axis of rotation and mounted in said housing, said rotor having a plurality of hollow radially extending pistons spaced from each other in a circumferential direction; a plurality of cup-shaped cylinders located in said housing and spaced from each other in the circumferential direction, each cylinder being mounted on and displaceable over the respective piston, said housing having two cam tracks spaced from each other in an axial direction of the rotor, each of said cylinders having two journals extending oppositely in said axial direction, each of said journals carrying a control roller abutting against the respective cam track and cooperating therewith; a central control shaft concentrically mounted in said rotor and conveying a pressure fluid, said control shaft communicating with said hollow pistons to feed the pressure fluid to said hollow pistons, said rotor having a flange portion on a driven side thereof, said flange portion being coaxial with said central axis; said rotor being mounted in said stationary housing by a single roller bearing adapted to absorb radial and axial forces exerted on said rotor in operation, said bearing being radially outwardly offset from said axis and positioned between said flange portion and said housing.

According to a further feature of the present invention the housing may be a one-piece cylindrical hollow element having an end wall, said end wall being formed with a central aperture to receive said rotor with said control shaft therein, said housing having an inner peripheral wall at an end of the housing opposite to said end wall, said inner heripheral wall being formed with a conical groove which receives said roller bearing.

Furthermore, the bearing roller has an axis parallel to the central axis of the rotor, the journals of each cylinder having axes, the axis of said bearing roller being arranged at a greater distance from the central axis of the rotor that the axes of the journals of the cup-shaped cylinders.

As compared to the previously known hydraulic motors in which the rotor always had two bearing points in respect to which the bearings had to be adjusted, the hydraulic motor according to the invention has a shortened overall length resulted from the single roller bearing point. Due to the fact that the roller bearing is situated as far as possible outwardly on the power take-off or driven side of the rotor and can be designed as a play-free bearing, preferably as a so-called four-point ball bearing, tilting and transverse forces exerted on the rotor by a machine part fastened to the flange wall or portion of the rotor are intercepted and absorbed directly by the roller bearing and not transmitted to the remaining part of the rotor. The hub part of the rotor slipped onto the central control shaft is thus not subjected to the action of tilting and transverse forces so that the fit between the rotor and control shaft is not endangered. Thus, according to a further feature of the invention the roller bearing may be formed as a four-point ball bearing in which two ball points lie in said conical groove in said inner peripheral wall of the housing, said flange portion of the rotor having an oblique edge surface against which a third ball point of the roller bearing lies, and wherein a check ring is provided concentric to said rotor and arranged closely adjacent and connected to said flange portion, said check ring having another oblique edge surface against which a fourth ball point of the bearing roller lies.

In the design of the hydraulic motor as a speed-switchable motor similar to that disclosed in German Pat. No. 28 53 552, a further shortening of the overall length of the motor is achieved in the present invention by the reduction of the diameters of the radial pistons and by the corresponding reduction of the diameters of the cylinders of the rotor, and also by subdividing the interior of each of the pistons into two chambers which can be supplied with pressure fluid independently from each other.

According to a still further feature of the invention each of the hollow pistons may be subdivided into two chambers, each of said chambers being supplied with pressure fluid from said control shaft independently from each other, for a stroke volume adjustment, said control shaft being displaceable in the axial direction between a plurality of operating positions to cooperate with said pistons, each of said pistons including a transversal wall subdividing the respective piston into said two chambers, said chambers asymmetrically lying with respect to a central axis of said piston, each of said cup-shaped cylinders having a corresponding inner projection engaged in and displaceable in one of said chambers, said projection being also asymmetrical with respect to said central axis of the piston assigned to the respective cylinder. Due to the arrangement of the rotors with two asymmetrical chambers a considerable shortening in overall length of the motor can be obtained both in the case with the motors with stable speed and in the case of speed switchable stroke-adjustment motors. The loading of the rotor of the hydraulic motor according to the invention can be also relieved in that the rotor may be provided with a plurality of axial webs which project between said cup-shaped cylinders, said webs having longitudinal rolling surfaces, each of the journals of the cylinders being provided with an entrainment roller rolling along a respective one of said longitudinal rolling surfaces of said webs. In this embodiment the torque transmission of the rotor is effected by means of entrainment rollers of the cylinders and the axial webs to the flange portion of the rotor.

Furthermore, a brake disc can be rigidly connected to the flange portion of the rotor, which portion has a large area; machine parts carrying the wheel body of a vehicle wheel can be securely fastened to that large-area flange portion; this means an increased security of the drive connection due to a lesser loading of the individual fastening points for fastening machine parts to the hydraulic motor.

Furthermore, a number of said pistons and the assigned cylinders in said rotor may be even, the pistons and the assigned cylinders being symmetrically distributed in a circumferential direction of the rotor.

As a result of symmetrical distribution of the pistons and respective cylinders over the periphery of the rotor a further equalisation of forces acting on the rotor is obtained so that a deformation of the rotor which would lead to the jamming of the rotor on the control shaft is prevented from the occurrence. The rotor thus can be arranged on the control shaft with an efficient fit even without bearings to be mounted on two opposite sides of the rotor. The design of the hydraulic motor according to the invention does not cause a large play between the rotor and the control shaft which play would lead to worsening in efficiency of the motor due to a higher oil leakage between the rotor and control shaft.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWINGS

FIG. 2 is a front view of the motor seen from arrow A of FIG. 1 and also illustrating three sectional sectors taken respectively along lines II—II, IV—IV and V—V of FIG. 1; and FIG. 3 is a side view of the rotor with an individual radial piston shown in section.

DETAILED DESCRIPTION OF THE PREFERRED EMBODIMENTS

Figure 1:
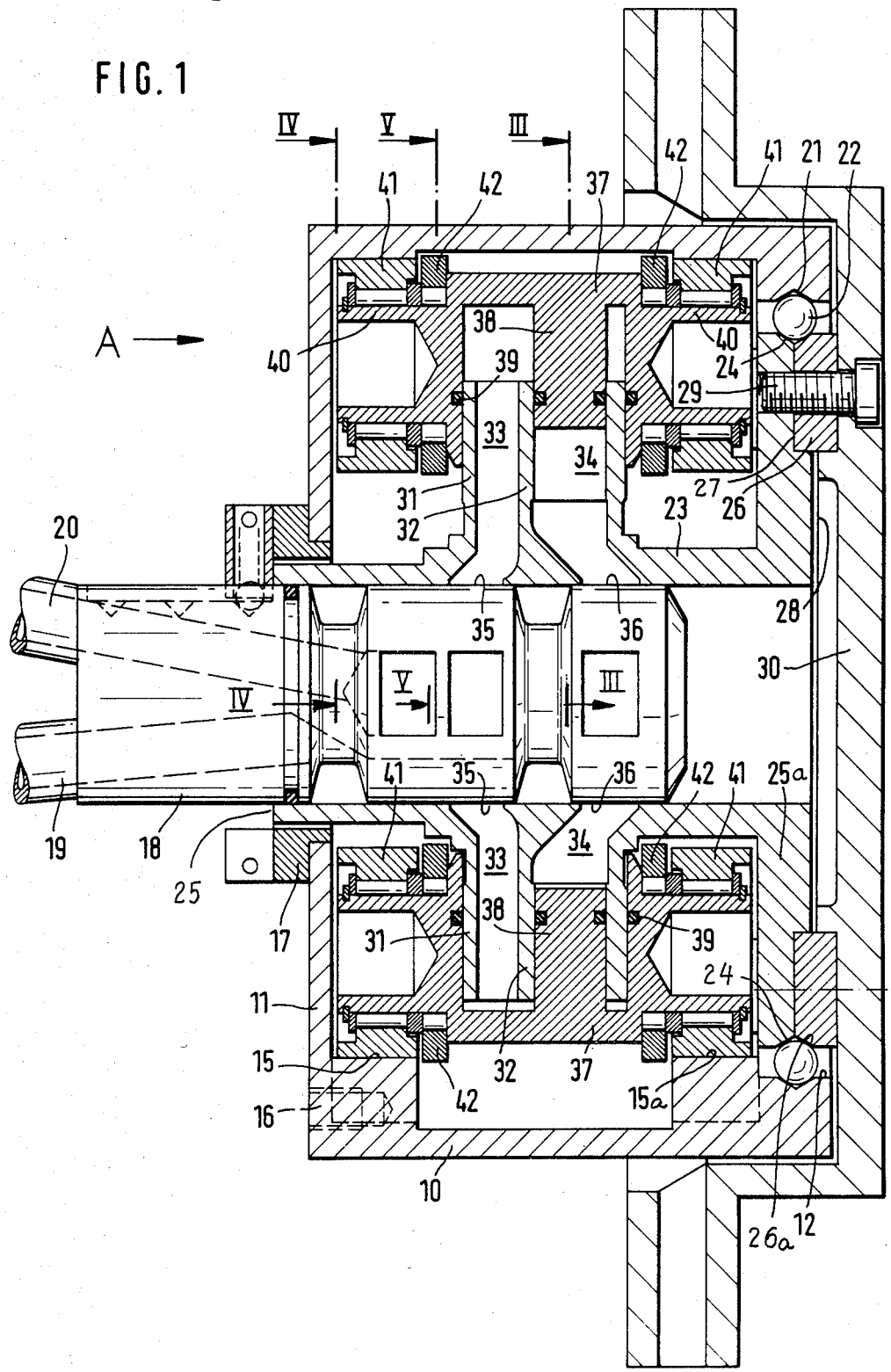
FIG. 1 is a longitudinal sectional view through a hydraulic radial multi-piston motor taken along line I—I of FIG. 2.

Referring now to the drawings, and first to FIG. 1, the hydraulic radial multi-piston motor according to the invention is comprised of a cup-shaped cylindrical housing 10 which is a stator of the motor, housing 10 having a rear end wall 11 and being formed with an opening defining an inner peripheral wall or edge 12.

The end wall 11 is provided with a central bore which receives a retaining ring 17. A multi-piston hollow rotor 23 is mounted within the housing 10. The rotor has a hub or flange 25 axially extended from one end of the housing to another. Hub 25 of the rotor is mounted on an axially-movable rotor control shaft 18 which projects axially outwardly of housing 10 and is provided with operating fluid connection lines 19 and 20 which lead in the known fashion to an operating fluid carrying part of the motor (not shown in the drawing and known in the art).

Rotor 23 has a number of pistons 31 radially outwardly projected from hub 25. On each piston is arranged a cup-shaped radially slidable cylinder 37.

The inner wall of housing 10 is formed with two similar thicker portions 15 each fromed with a cam track **15*a* for cylinders 37 also shown in FIG. 2**.

Formed in the thicker wall portions with cam tracks **15*a* are threaded bores 16 which serve for fastening the housing 10** of the motor, for example to a wheel suspension of the vehicle.

The internal peripheral edge 12 of the housing is formed with a V-shaped groove 21 which is a bearing groove for balls 22 of a roller bearing.

In the inventive embodiment the roller bearing having balls 22 is mounted radially as far away from the central axis of the rotor shaft 18 as possible. The roller bearing is designed as a four-point ball bearing which absorbs radial and axial forces exerted on the rotor and forms a single bearing support for the rotor 23 of the motor in the housing or stator 10. The rotor-side counter running surfaces for balls 22 are formed, on the one hand, by a sloped edge 24 formed on the flange portion **25*a* of hub 25 and, on the other hand, by a sloped edge or surface 26*a* formed on an attachment or check ring 26 provided in the motor and mounted to an end face 28 of hub 25. The attachment ring 26 abuts against a shoulder 27 formed in the region of the end face 28 of hub 25. Screws 29 are provided to connect attachment ring 26 to hub 25. These screws also serve to fasten a brake disc 30 of the vehicle wheel to the flange portion 25*a* of hub 25. Flange wall 25*a* forms a driven side end of the rotor 23 which is displaceable with sliding fit on the central rotor shaft 18. Hub 25 as has been mentioned above is formed in the central region thereof into a piston spider having six symmetrically distributed hollow radial pistons 31 with cylinders 37** slidable thereon.

As shown in FIGS. 1 and 3, each piston 31 is formed with two assymetrically-arranged chambers 33 and 34 which are separated from each other by a substantially radially extended transverse wall 32. The latter separates respective fluid connection openings 35 and 36 from each other in such a manner that chambers 33 and 34 can be supplied with pressure fluid from suitable passages of the axially displaceable rotor shaft 18 receiving operating pressurized fluid from respective fluid connections, independently, or separately from each other. The cooperation of the rotor shaft 18 with the individual chambers of six radial pistons 31 is known in the art and is not of interest of the present application. This cooperation is described in U.S. Pat. No. 4,318,336, the entire disclosure of which is incorporated herein by reference.

With reference to FIGS. 2 and 3 it will be seen that the cup-shaped cylinder 37 is superimposed onto each one of six radial pistons 31; cylinder 37 is guided, on the one hand, on the cylindrical periphery of radial piston 31 and, on the other hand, with its guide projection 38 into chamber 34 formed in the piston 31. The sealing of cylinder 37 relative to respective piston 31 is effected by means of conventional sealing rings inserted into annular grooves 39 formed in cylinder 37 as shown in sectional sector II—II of FIG. 2.

As further shown in FIG. 2, section V—V, and FIG. 3, each cylinder 37 is provided on two opposite end sides thereof with partially hollow axle journals 40 extended in the direction of elongation of shaft 18, journals 40 being provided with control rollers 41 mounted by means of needle bearings 50; rollers 41 are adapted to roll on cam tracks 15*a* of wall portions 15 of the housing 10.

With reference to FIG. 3 it will be seen that in addition to rollers 41 relatively thin entrainment rollers 42 are also mounted by means of bearings on axle journals 40. The hub 25 of rotor 23 is formed with axial webs 44 which extend radially between individual cylinders 37 of the rotor. Entrainment rollers 42 abut against lateral running faces 43 of axial webs 44 so that the entrainment rollers 42 transmit the torque from cylinders 37 through the respective axial webs 44 to the driven-side flange portion 25*a* of the rotor.

The above described radial hydraulic multiple-piston motor forms a so-called wheel hub motor and is designed so that it is extremely compact in the radial direction and the axial direction as well. Due to the bearing arrangement of the motor and the arrangement for transmission of torque according to the invention the motor has a relatively short overall length, has an extremely sturdy construction which is oapable of releasing the rotor from dangerous bending forces.

The single roller bearing with balls 22 employed in the hydraulic motor of the invention is placed as far radially outwardly from the central axis of the rotor shaft as possible so that the roller bearing peripheral surface of the bearing is remoter from the central axis of the shaft 18 than the running track of axle journals 40.

It will be understood that each of the elements described above, or two or more together, may also find a useful application in other types of hydraulic motors differing from the types described above.

While the invention has been illustrated and described as embodied in a hydraulic motor, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A multi-piston hydraulic motor, comprising a stationary housing; a rotor having a central axis of rotation and mounted in said housing, said rotor having a plurality of hollow radially extending pistons spaced from each other in a circumferential direction; a plurality of cup-shaped cylinders located in said housing and spaced from each other in the circumferential direction, each cylinder being mounted on and displaceable over the respective piston, said housing having two cam tracks spaced from each other in an axial direction of the rotor, each of said cylinders having two journals extending oppositely in said axial direction, each of said journals having axes and carrying a control roller abutting against the respective cam track and cooperating therewith; a central control shaft concentrically mounted in said rotor and conveying a pressure fluid, said control shaft communicating with said hollow pistons to feed the pressure fluid to said hollow pistons, said rotor having a flange portion on a driven side thereof, said flange portion being coaxial with said central axis; said rotor being mounted in said stationary housing by a single roller bearing formed as a four-point ball bearing to absorb radial forces and axial forces in both axial directions exerted on said rotor in operation, said bearing being positioned between said flange portion and said housing and being radially outwardly offset at a greater distance from said central axis than the axes of said journals.

2. The hydraulic motor as defined in claim 1, wherein each of said hollow pistons is subdivided into two chambers, each of said chambers being supplied with pressure fluid from said control shaft independently from each other, for a stroke volume adjustment, said control shaft being displaceable in the axial direction between a plurality of operating positions to cooperate with said pistons, each of said pistons including a transversal wall subdividing the respective piston into said two chambers, said chambers being disposed asymetrically with respect to a central axis of said piston, each of said cup-shaped cylinders having a corresponding inner projection engaged with and displaceable in one of said chambers, said projection being also asymmetrical with respect to said central axis of the piston assigned to the respective cylinder.

3. The hydraulic motor as defined in claim 1, wherein said bearing roller has an axis parallel to the central axis of the rotor, said journals of each cylinder having axes, the axis of said bearing roller being arranged at a greater distance from the central axis of the rotor than the axes of the journals of said cup-shaped cylinders.

4. The hydraulic motor as defined in claim 1, wherein said housing has an inner peripheral wall formed with a conical groove, and wherein two ball points of said four-point ball bearing lie in said conical groove in said inner peripheral wall of the housing, said flange portion of the rotor having an oblique edge surface against which a third ball point of the roller bearing lies, and wherein a check ring is provided concentric to said rotor and arranged closely adjacent and connected to said flange portion, said check ring having another oblique edge surface against which a fourth ball point of the bearing roller lies.

5. The hydraulic motor as defined in claim 1, wherein a number of said pistons and the assigned cylinders in said rotor is even, the pistons and the assigned cylinders being symmetrically distributed in a circumferential direction of said rotor.

6. The hydraulic motor as defined in claim 5, further including a brake disc rigidly connected said flange portion of the rotor and coaxially therewith, said brake disc being connectable to a vehicle wheel concentrically therewith.

* * * * *